US008328350B2

(12) United States Patent
Fetherolf

(10) Patent No.: US 8,328,350 B2
(45) Date of Patent: Dec. 11, 2012

(54) VERTICAL MOUNT PRINTING DEVICE

(75) Inventor: Will G. Fetherolf, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2369 days.

(21) Appl. No.: 10/086,908

(22) Filed: Feb. 28, 2002

(65) Prior Publication Data

US 2003/0160853 A1 Aug. 28, 2003

(51) Int. Cl.
*B41J 2/01* (2006.01)

(52) U.S. Cl. ..... 347/104; 347/101

(58) Field of Classification Search ..... 347/101, 347/104, 105, 108, 109
See application file for complete search history.

(56) References Cited

U.S. PATENT DOCUMENTS

| | | | | | |
|---|---|---|---|---|---|
| 3,990,670 | A | * | 11/1976 | Frechtman | 248/470 |
| 4,074,872 | A | * | 2/1978 | Marshall, Jr. | 242/597.7 |
| 4,164,269 | A | * | 8/1979 | Jackson | 182/229 |
| 4,207,578 | A | * | 6/1980 | Marinoff | 347/35 |
| 4,546,973 | A | * | 10/1985 | Mouser | 473/472 |
| 4,570,802 | A | | 2/1986 | Murphy | |
| 4,828,416 | A | * | 5/1989 | Pensavecchia et al. | 400/624 |
| 4,909,466 | A | * | 3/1990 | Matthews | 248/303 |
| 4,982,927 | A | | 1/1991 | Zajeski et al. | |
| 5,110,226 | A | * | 5/1992 | Sherman et al. | 400/88 |
| 5,238,235 | A | * | 8/1993 | Nitta et al. | 271/9.09 |
| 5,350,246 | A | | 9/1994 | Sehringer | |
| 5,397,192 | A | * | 3/1995 | Khormaee | 400/708 |
| 5,527,006 | A | * | 6/1996 | Stith | 248/231.51 |
| 5,731,829 | A | * | 3/1998 | Saito et al. | 347/104 |
| 5,784,171 | A | * | 7/1998 | Kano | 358/296 |
| 5,913,628 | A | * | 6/1999 | Sides, II | 400/679 |
| 5,929,894 | A | * | 7/1999 | Kikuchi | 347/262 |
| 6,027,211 | A | * | 2/2000 | Unosawa et al. | 347/104 |
| 6,091,514 | A | * | 7/2000 | Hasegawa et al. | 358/296 |
| 6,173,551 | B1 | * | 1/2001 | Bowman et al. | 53/131.4 |
| 6,290,349 | B1 | * | 9/2001 | Silverbrook et al. | 347/87 |
| 6,405,055 | B1 | * | 6/2002 | Silverbrook et al. | 455/556 |
| 6,628,430 | B1 | * | 9/2003 | Silverbrook et al. | 358/473 |
| 2001/0033314 | A1 | * | 10/2001 | Yoshino et al. | 347/86 |

(Continued)

FOREIGN PATENT DOCUMENTS

EP 451828 A2 * 10/1991

(Continued)

OTHER PUBLICATIONS

Merriam-Webster's Collegiate Dictionary Tenth Edition; Merriam-Webster, Incorporated, Tenth Edition; pp. 137, 526, 841.*

(Continued)

*Primary Examiner* — Stephen Meier
*Assistant Examiner* — Leonard S Liang

(57) ABSTRACT

A media processing device adapted for support from a vertical structure. The media processing device may employ a laser printer, an inkjet printer, or other printing media processing technology. A media processing engine outputs media in a downward direction. A support bracket is coupled to the media processing engine and is adapted to support the media processing engine from a vertical structure, which may be a parapet wall. A media receiver is coupled to the bottom of the media processing engine and receives discharged media therefrom. In an illustrative embodiment, the media processing device is also adapted to rest on a horizontal structure. The support bracket and media receivers rotate to accomplish the transition from vertical to horizontal mounting. A simplified straight-through media path is utilized in the media processing device, which advantageously utilizes the force of gravity.

15 Claims, 3 Drawing Sheets

U.S. PATENT DOCUMENTS

| | | | | |
|---|---|---|---|---|
| 2002/0179793 | A1 * | 12/2002 | Wang | 248/308 |
| 2003/0128253 | A1 * | 7/2003 | Kitahara et al. | 347/42 |

FOREIGN PATENT DOCUMENTS

| | | | |
|---|---|---|---|
| GB | 2221193 | | 1/1990 |
| GB | 2229142 | | 9/1990 |
| JP | 2-18259 | | 1/1990 |
| JP | 020018259 | | 1/1990 |
| JP | 2000184911 | A * | 7/2000 |

OTHER PUBLICATIONS

Machine-Assisted Translation of JP2000-184911-A [This is official translation].*
Human Translation of JP 2000-184911.*
UK Search Report Under § 17(5) Patents Act 1977, Jun. 20, 2003; 2 Pgs.

* cited by examiner

VERTICAL MOUNT PRINTING DEVICE

BACKGROUND OF THE INVENTION

1. Field of the Invention

The present invention relates to printers. More specifically, the present invention relates to printers that are adapted to mount on walls and other vertically oriented structures and surfaces.

2. Description of the Related Art

Home and office printing devices are widely deployed and are frequently coupled to personal computers or computer networks. Personal computer printing devices commonly employ laser printing engines or inkjet printing engines, although other printer technologies are known. Laser and inkjet printing engines are also utilized in other printing devices, such as facsimile machines, copiers, multi-function peripherals, and other print and graphic producing machines (collectively "printing devices").

Printing devices known in the prior art are designed for use on a flat, horizontal surface. Such surface area may be a desk top, table top, a cabinet or other item of furniture that is characterized as having a flat, horizontal surface. Some printing devices are known to be freestanding units, but these devices ultimately rest on the floor, a flat and horizontal surface. Thus, it is understood that printing devices consume some amount of surface area in the home, business or office in which they are located.

The amount of surface area consumed by modern printing devices varies somewhat based on the size and capacity of the printing device. In addition to the printing device itself, additional surface area is often consumed by media input and output trays.

A typical example of a personal laser printer known in the prior art has an output tray in the front and an input tray on the top that extends somewhat to the rear of the device. When space is allowed for ventilation, power and connecting cables, as well as user access, the horizontal surface area consumed by typical conventional printing devices often consumes the complete front-to-back area of a desk, table, or cabinet. Even a small personal laser printer, for example, will often consume an area about 18" wide and 24" deep, representing an area of 3 square feet. Higher capacity printers consume even more area.

The desktop area consumed by printing devices is usually at a premium, whether it is in a home, business or office environment. Consider the modern office environment with many employees in a given facility, most of whom have a personal printer or are members of a small group of people that share a printer. Office space is allocated and the cost associated therewith is based on square footage basis. Businesses frequently strive to keep the total square footage area, on a per employee basis, at a minimum. In an office cubical environment, per-employee cubical space is often limited to 36 square feet, sometimes less. As noted above, prior art printing devices consume about 3 square feet, perhaps more, of space. This represents 8% or more of the space in an individual's office space allocation.

Thus, there is a need in the art a system or method for reducing the surface area required by office machines generally and printing devices in particular.

SUMMARY OF THE INVENTION

The need in the art is addressed by the teachings of the present invention. A media processing device adapted for support from a vertical structure is taught. The device includes a media processing engine that has a media output oriented to discharge media in a downward direction and a support bracket coupled to the media processing engine. The support bracket is adapted to be suspended from a vertical structure. A media receiver is coupled to the media processing engine and positioned to receive the media discharged therefrom. The media processing engine may be a laser printing engine, an inkjet printing engine, or other media processing engine as are known to those skilled in the art.

In a refinement of the apparatus, the media processing engine employs a straight-through media path, and has a media input on the top of the media processing engine, with the media output being on the bottom of the media processing engine. The simplified design allows the media to be initially fed into the media input by gravity. The apparatus is particularly suitable for mounting on a vertical structure when the media processing engine is vertically oriented, with an overall size defined in terms of its height, width, and depth, and where the depth is smaller than the height and the width.

The support bracket may be adapted for support from the vertical surface by a means for fastening the support bracket to the vertical structure, which may be any of the types of means for fastening known to those skilled in the art. In a particular embodiment, the vertical structure is a parapet wall and the support bracket is formed as a hook-like structure to engage the top of the parapet wall for support.

In a refinement of the invention, the media receiver receives and supports the discharged media in a vertical orientation. In another refinement, the discharged media is transferred from the media output to the media receiver by gravity force. The media receiver may be adapted to order a plurality of media received from the media output by gravity force.

A dual support apparatus is also taught which is adapted for support from a vertical structure or a horizontal structure. The dual support apparatus includes the media processing engine with a media output oriented to discharge media in a downward direction and a support bracket coupled to the media processing engine. The support bracket is rotatable between a first position adapted for support of the media processing engine by hanging from the vertical structure and a second position adapted for inclined support of the media processing engine on the horizontal structure. Also, a media receiver is coupled to the media processing engine. The media receiver is rotatable between a vertical position below the media processing engine for receiving the media when the media processing engine is supported from the vertical structure, and a horizontal position, substantially parallel to the horizontal structure, for receiving media when the media processing engine is supported on the horizontal structure.

DESCRIPTION OF THE INVENTION

Figure 1:
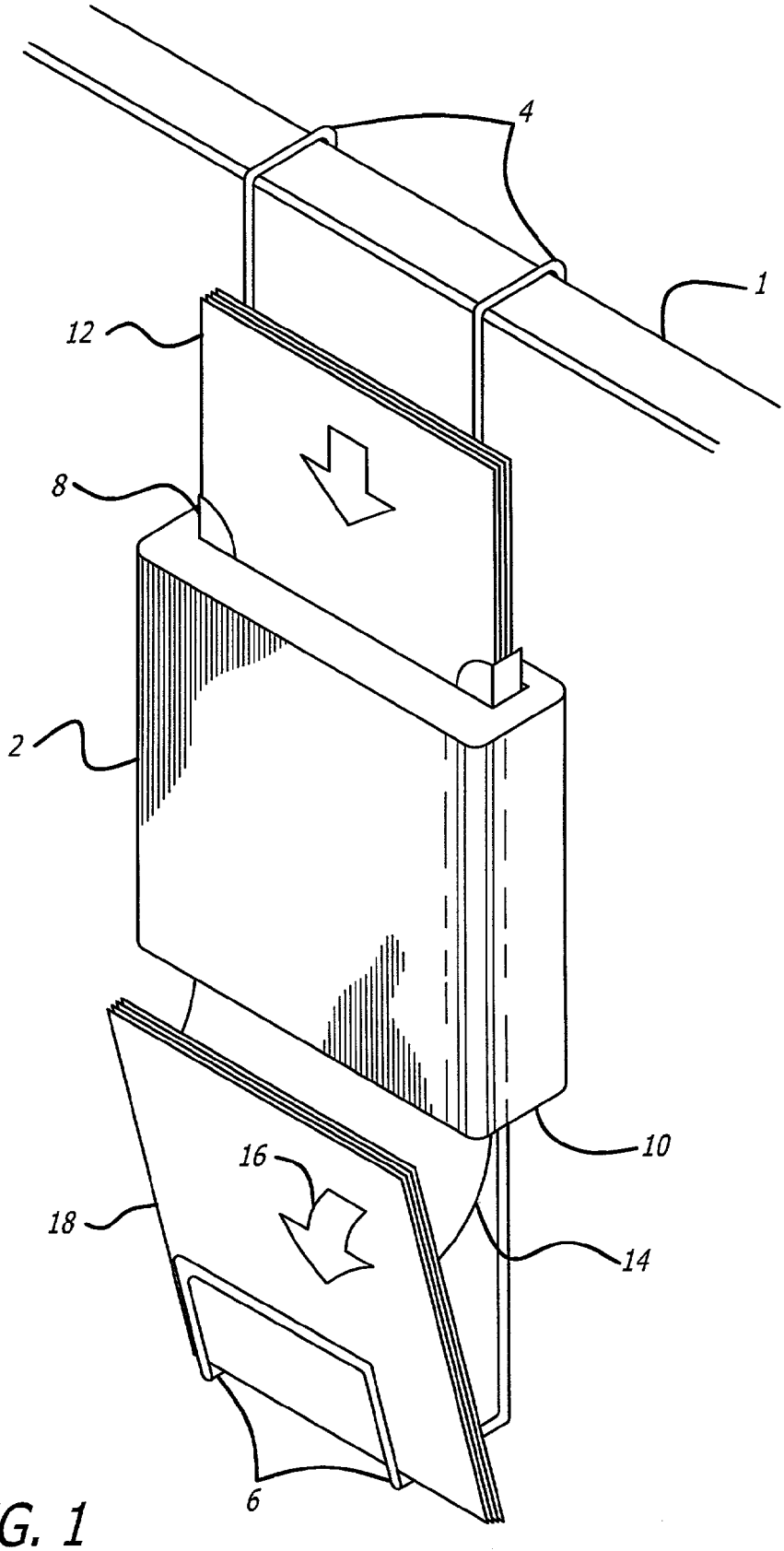
FIG. 1 is a perspective view of a laser printer according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

In an illustrative embodiment, the present invention teaches a personal laser printer for use in an office environment, where space is at a premium. The laser printer is designed to hang, or is otherwise supported, from a wall. A vertical, straight-through, paper path is employed so that the force of gravity can be advantageously utilized for the media feeding processes. Paper is loaded and fed into the top of the printer and is then output downwardly from the bottom of the printer into a media receiver. As the media exits the printer, the media falls forward so that media output order is correctly preserved. To enhance versatility, the printer can be converted for use on a horizontal surface, such as a desk, simply by rotating the hanging support bracket to become a support stand for the printer.

More generally speaking, the concept is advantageous because it gets the printer off of the desk surface, which is at a premium, and puts the printer conveniently onto a wall surface. The concept is particularly applicable to the single user personal laser printer, but it is also useful for networked printers and other multiple user printers. The concept is applicable for printing devices that are laser based, inkjet based, or employ any other printing technology known to those skilled in the art. Many modern offices employ flexible partition systems, commonly referred to as cubicle systems, which utilize partial height parapet walls to define office work areas. In one illustrative embodiment of the present invention, the support bracket is formed in a hook shape that hangs over the top of the cubicle parapet walls. This approach affords remarkable simplicity in installing, using, and relocating printers within the office environment. Even in cramped office quarters, there is usually some free wall space where the present invention printer can be installed. Free desk space is thus preserved for other uses.

As noted above, the present invention printer uses a straight through paper path, which is an economical design due to its simplicity. Paper is loaded into a media input at the top of the printer and passes through a straight-through paper path to a media receiver at bottom of the printer. The arrangement is vertical, which is consistent with the vertical orientation of walls. Gravity is advantageously used to assist the media feeding process. The initial paper feed is by gravity force. The media output discharges under force of gravity. And, the force of gravity accomplishes the output sort. Thus, the number of media-drive roller sets and other media control components are kept to a minimum, which reduces size and cost, as well as enhancing reliability. A secondary media feed slot can be added at the top of the printer for single sheet and envelope feeding. Secondary media slots are known to those skilled in the art. Data cable and power wiring connect at the bottom or lower sides of the printer and are routed to the connected computer and power outlet respectively. The Universal Serial Bus ("USB") interface is preferred because of its universal applicability, small size, and low cost. Of course, other interface standards can be readily applied to the present invention printer, including networked interfaces. The aforementioned simplicity of design implies a physically small printer. The straight through media path defines a printer that is long, somewhat wider than the media it processes, but not very deep. When deployed in a vertical position, the length of the printer defines its height, which is extended by the media input, support bracket, and media receiver. A relatively long height is suitable for vertical wall mount applications. The width is modest, perhaps 12 to 13 inches for 8⅕ inch media. The depth can be held to about 4 inches. Thus, the present invention printer does not extend very far out from the wall surface, has only a modest width, and utilized the vertical space that is otherwise not even consumed in most office environments.

Reference is directed to FIG. 1, which is a perspective view of a laser printer 2 according to an illustrative embodiment of the present invention. The laser printer 2 is of the straight-through media path design having a media input 8 at the top and a media output 10 (not visible) at the bottom. Paper media 12 is inserted into media input 8. A support bracket 4 is rotatably coupled to the back of the printer near the top and extends upwardly and forms a hook-like shape over the top of the parapet cubicle wall 1 onto which the printer is hung.

The support bracket 4 is fabricated from medium gauge steel wire, such as wire in the #4 AWG to #12 AWG size range. Steel wire is rigid and malleable so that it can be readily bent and fabricated into the required shape. A single piece of wire is bent into a squared "U" shape having a width equal to approximately two-thirds of the printer 2 width. The length is sufficient so that the two sides of the wire can be bent twice each to form a squared hook-shape that engages the top of the parapet wall 1. Modern cubical systems have walls that are about three to four inches thick, so the squared hook should be approximately four inches deep to accommodate such walls. When hung over the parapet wall, the two ends of the bracket 4 wire extend downwardly to engage and support the printer. The wire ends are bent outwardly along a single axis so as to define and hinge pin for coupling with the printer. The printer has the hinge bosses (shown in FIG. 2 and FIG. 3) into which the hinge pins are inserted. This forms a rotatable coupling between the bracket 4 and the printer 2.

In the illustrative embodiment of FIG. 1, the support bracket 4 is formed from metal wire, however, those skilled in the art will appreciate that many materials are available and suitable for the support bracket 4 function. While the parapet wall bracket 4 is illustrated, many other means for connecting or hanging from a wall or other vertical structure can be employed in and with support bracket 4. Nails, screws, hooks, drywall fasteners, adhesive, and any other means known to those skilled in the art are appropriate for use with the present invention wall support bracket 4.

A media receiver basket 6 is coupled to the bottom of the printer 2 in the illustrative embodiment. The media receiver 6 is also formed from metal wire in the illustrative embodiment, however, any material suitable for this function may be utilized. The media receiver basket 6 is formed from the same, or similar, steel wire as the support bracket 4. The media receiver basket 6 is also formed in a hook-shape, which is sized to support the media 18 discharged from the printer 2. The hook-shape of the media receiver 6 is in an inverted position with respect to the support bracket 4. The two wire ends that extent upwardly and engage the printer are bend outwardly along a single axis so as to define a hinge pin for rotatable coupling to hinge bosses in the printer (see FIG. 3 and FIG. 4).

The media is discharged 14 from the media output 10 and falls by force of gravity into the media receiver basket 6. The front, hook-shaped, portion of media receiver basket 6 is canted forward from vertical so that the media leans forward as shown at 16 and away from the wall as they are discharged. The leaning action serves to clear the accumulating media 18 away from the area where each subsequent page of media falls, and also organize plural pages of media 18 output 14 from the printer 2 in the order in which they were printed.

Figure 2:
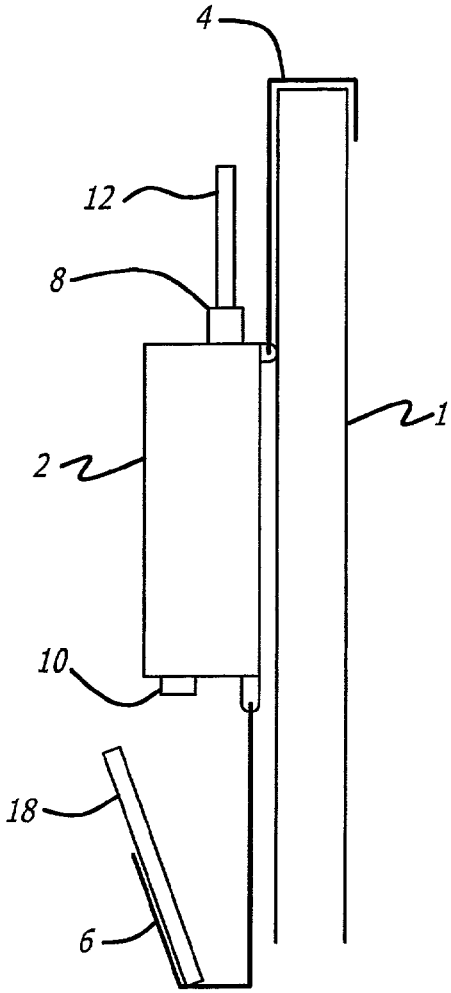
FIG. 2 is a diagram of a laser printer hanging from a parapet wall according to an illustrative embodiment of the present invention.

Reference is directed to FIG. 2, which is a side view diagram of a laser printer 2 hanging from a parapet wall 1 according to an illustrative embodiment of the present invention. The vertical arrangement of the illustrative embodiment is readily apparent in FIG. 2. The support bracket 4 is square hook-shaped to hang over the top of the parapet wall 1. The support bracket 4 is rotatably coupled to the back of the printer 2 near the top through a pair of hinge bosses into which the outwardly turned ends of the support bracket 4 wire are inserted. The media input 8 is filled with paper media 12 in the illustrative embodiment. The media is output from the printer 2 at media output 10 located at the bottom of printer 2. The media receiver basket 6 is rotatably coupled to and hangs from the bottom of printer 2 through a pair of hinge bosses into which the outwardly turned ends of the media support basket 6 wire are inserted. Plural pages of media 18 accumulate in the media receiver 6 as they are discharged from media output 10.

Figure 3:
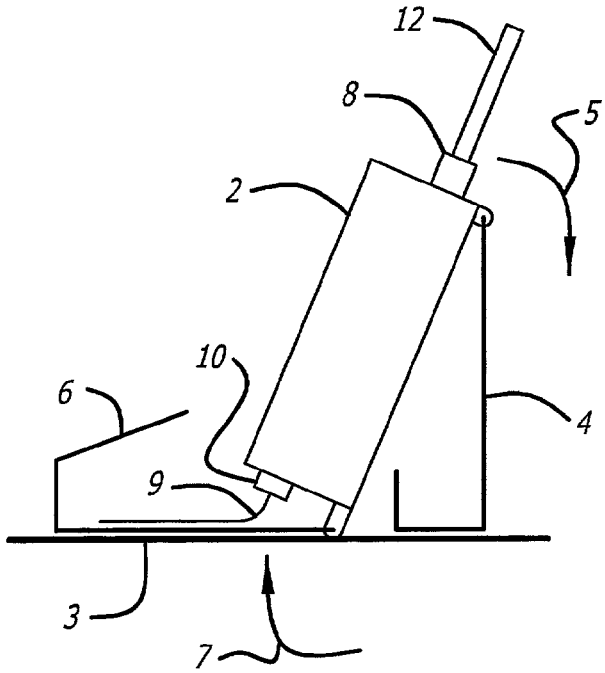
FIG. 3 is a diagram of a laser printer resting on a horizontal structure according to an illustrative embodiment of the present invention.

Reference is directed to FIG. 3, which is a side view diagram of a laser printer 2 resting on a horizontal structure 3 according to the illustrative embodiment of the present invention. The advantageous design of the support bracket 4, media receiver basket 6, and their respective rotatable couplings are apparent in FIG. 3. As compared to the vertical mount illustrated in FIG. 2, the support bracket 4 in FIG. 3 has been rotated 5 to a downward direction. The hook shaped end of the support bracket 4 serves as a base of support for the printer 2 against the horizontal structure 3 on which the printer rests. That horizontal structure 3 may be a table, desk, cabinet or other furniture item, for example. The media receiver 6 also rotates 7 to an outward direction, substantially parallel with the horizontal structure 3. The printer 2 is inclined at an angle of approximately fifteen degrees by virtue of the differential in length between the support bracket 4 and the printer 2 itself. Plural pages of media 12 are inserted into media input 8, and are then printed by the printer 2 from time to time. The angle of inclination provides an area for the media output 10 to output pages of media 9 into the media receiver basket 6. Thus the illustrative embodiment printer is useful not only from the vertical wall mount application, but also for use in horizontal mount situations.

Figure 4:
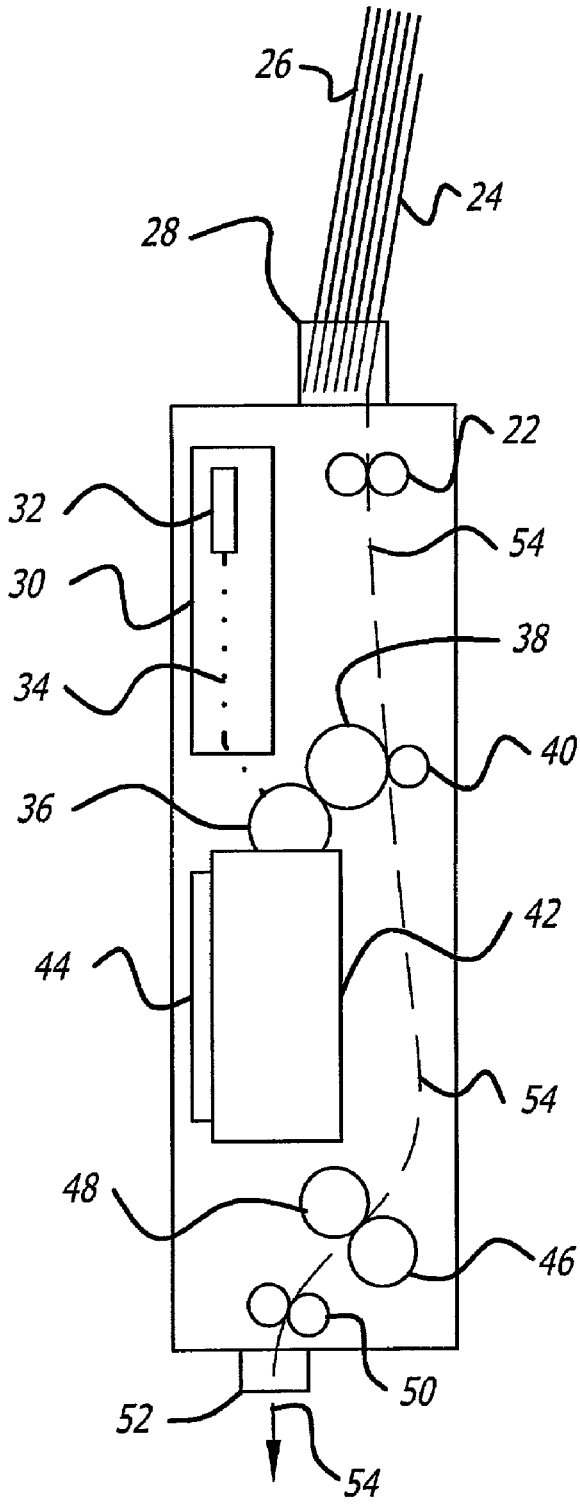
FIG. 4 is a section view of a laser printer according to an illustrative embodiment of the present invention.

Reference is directed to FIG. 4, which is a section view of a laser printer according to an illustrative embodiment of the present invention. FIG. 4 illustrates the simplicity of a straight-thorough paper path print engine as applied in the illustrative embodiments of the present invention. Plural pages of media 26 are inserted into media input 28 for subsequent use in printing operations. From time to time a printing operation is commenced and a single sheet of media 24 is fed by gravity force to engage media feed pinch rollers 22, which urge the media 24 along media path 54. In preparation of printing, the laser scanning unit 30 converts printed image data that is emitted as a pulsed laser beam 34 from laser 32. The pulsed laser beam is scanned onto photoconductive drum 36 by laser scanning unit 30, and thus a latent electrostatic image is formed onto photoconductive drum 36. Photoconductive drum 36 rotates and is developed by developing unit 42. The latent image is developed by electrostatic transfer of toner from toner cartridge 44 onto photoconductive drum 36 by developer unit 42. These transfer processes are known to those skilled in the art.

The developed toner image is transferred from the photoconductive drum 36 to the intermediate transfer drum 38 by electrostatic force as the two drums rotate together. As the media 24 follows media path 54 it is pinched between intermediate transfer drum 38 and its pressure roller 40 to transfer the toner image to the media. The media is also urged forward by the intermediate transfer drum 38, and its pressure roller 40, toward the fusing unit. The fusing unit consists of a fusing roller 48 and a pressure roller 46. Together, these rollers apply heat and pressure to fuse the toner to the media. The media is also further driven along media path 54 to the output pinch rollers 50. Output pinch rollers 50 urge the media out of the media output opening 52 to complete the media path 54, where the media falls into a media receiver (not shown).

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A media processing device for use with a structure having a first vertical surface with an upper most extremity, the device comprising:

a media processing engine having an outer housing with a media input along a first external face of the housing and configured such that a portion of a medium extends outwardly beyond the input as the medium is being mechanically fed towards the engine and an output along a second external face of the housing, wherein the first face and the second face are opposite one another; and a support coupled to the engine and configured to couple the engine to the structure such that the media output is below the uppermost extremity of the first vertical surface, wherein the media input is configured to receive media while the media is in a vertical orientation, wherein the media input is configured to receive media having a width of at least 8 inches.

2. The device of claim 1 wherein the engine, when vertically oriented, has a height, width, and depth and wherein the depth is smaller than the height and width.

3. A media processing device for use with a structure having a first vertical surface with an upper most extremity, the device comprising:

a media processing engine having an outer housing with a media input along a first external face of the housing and configured such that a portion of a medium extends outwardly beyond the input as the medium is being mechanically fed towards the engine and an output along a second external face of the housing, wherein the first face and the second face are opposite one another; and a support coupled to the engine and configured to couple the engine to the structure such that the media output is below the uppermost extremity of the first vertical surface, wherein the media input is configured to receive media while the media is in a vertical orientation;

a media receiver proximate the media output, wherein the receiver receives media from the media output while the media is in a substantially vertical orientation and holds the media in a substantially vertical orientation, wherein the receiver is configured to support the media in a tilted orientation directed away from the vertical surface.

4. The device of claim 3 wherein the receiver is configured to support the media such that at least a portion of the media extends beyond a front of the print engine opposite the vertical surface.

5. A media processing device for use with a structure having a first vertical surface with an upper most extremity, the device comprising:

a media processing engine having an outer housing with a media input along a first external face of the housing and configured such that a portion of a medium extends outwardly beyond the input as the medium is being mechanically fed towards the engine and an output along a second external face of the housing, wherein the first face and the second face are opposite one another; and a support coupled to the engine and configured to couple the engine to the structure such that the media output is below the uppermost extremity of the first vertical surface, wherein the media input is configured to receive media while the media is in a vertical orientation, wherein the media input is configured to receive an individual sheet of media from a stack of media positioned proximate the input.

6. A method for processing media comprising:

supporting a device having a media processing engine along a vertical surface;

mechanically feeding media through a media input along an external face of the device to the engine while the media is substantially vertical;

printing upon the media;

discharging the printed upon media out an external media output opposite the external media input from the engine while the media is in the substantially vertical orientation;

positioning a stack of individual sheets of media proximate to the media input.

7. A method for processing media comprising:

supporting a device having a media processing engine along a vertical surface;

mechanically feeding media through a media input along an external face of the device to the engine while the media is substantially vertical;

printing upon the media;

discharging the printed upon media out an external media output opposite the external media input from the engine while the media is in the substantially vertical orientation; and holding the ejected media below the media output.

8. A media processing device for use with a wall having a top edge and a horizontal surface, the device comprising:

a media processing engine;

an enclosure about the engine;

a support pivotally coupled to the enclosure, wherein the support pivots between a first position in which the support is configured to wrap about the top edge of the wall and a second position in which the support is configured to rest upon the horizontal surface so as to elevate at least a portion of the enclosure above the horizontal surface; and a media receiver pivotally coupled to the enclosure, wherein the media receiver pivots between a third position in which the media receiver is configured to extend along the wall while the support is in the first position, and a fourth position in which the receiver is configured to extend along the horizontal surface while the support is in the second position.

9. The device of claim 8, wherein the enclosure includes a media input along a first external face of the enclosure and a media output along a second external face of the enclosure.

10. A media processing device for use with a wall having a top edge and a horizontal surface, the device comprising:

a media processing engine;

an enclosure about the engine; and a support pivotally coupled to the enclosure, wherein the support pivots between a first position in which the support is configured to wrap about the top edge of the wall and a second position in which the support is configured to rest upon the horizontal surface so as to elevate at least a portion of the enclosure above the horizontal surface.

11. The device of claim 10 wherein the enclosure includes a media input along a first external face of the enclosure and a media output along a second external face of the enclosure opposite the first external face.

12. A media processing device for use with a wall and a horizontal surface, the device comprising:

a media processing engine;

an enclosure about the engine; and a media receiver pivotally coupled to the enclosure, wherein the media receiver pivots between a first position in which the media receiver is configured to extend along the wall, and a second position in which the receiver is configured to extend along the horizontal surface.

13. The device of claim 12 wherein the enclosure includes a media input along a first external face of the enclosure and a media output along a second external face of the enclosure opposite the first external face.

14. A media processing device for use with a wall and a horizontal surface, the device comprising:

a media processing engine;

an enclosure about the engine;

a support pivotally coupled to the enclosure, wherein the support pivots between a first position in which the support is configured to mount along a side of the wall and a second position in which the support is configured to rest upon the horizontal surface so as to elevate at least a portion of the enclosure above the horizontal surface; and a media receiver pivotally coupled to the enclosure, wherein the media receiver pivots between a third position in which the media receiver is configured to extend along the wall while the support is in the first position, and a fourth position in which the receiver is configured to extend along the horizontal surface while the support is in the second position.

15. The device of claim 14 wherein the enclosure includes a media input along a first external face of the enclosure and a media output along a second external face of the enclosure opposite the first external face.

* * * * *

UNITED STATES PATENT AND TRADEMARK OFFICE

CERTIFICATE OF CORRECTION

PATENT NO. : 8,328,350 B2
APPLICATION NO. : 10/086908
DATED : December 11, 2012
INVENTOR(S) : Will G. Fetherolf It is certified that error appears in the above-identified patent and that said Letters Patent is hereby corrected as shown below:

In column 7, lines 26-27, in Claim 6, after "orientation;" insert -- and --.

Signed and Sealed this
Twelfth Day of March, 2013

Teresa Stanek Rea
*Acting Director of the United States Patent and Trademark Office*